US009420365B2

(12) United States Patent
Xu

(10) Patent No.: US 9,420,365 B2
(45) Date of Patent: Aug. 16, 2016

(54) SILICON CONDENSER MICROPHONE

(71) Applicant: Congliang Xu, Shenzhen (CN)

(72) Inventor: Congliang Xu, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/524,104

(22) Filed: Oct. 27, 2014

(65) Prior Publication Data

US 2016/0029110 A1 Jan. 28, 2016

(30) Foreign Application Priority Data

Jul. 28, 2014 (CN) ..... 2014 2 0420268 U

(51) Int. Cl.

| | |
|---|---|
| ***H04R 19/04*** | (2006.01) |
| ***H04R 1/08*** | (2006.01) |
| ***H04R 1/22*** | (2006.01) |
| ***H04R 19/01*** | (2006.01) |

(52) U.S. Cl.

CPC ..... *H04R 1/08* (2013.01); *H04R 1/222* (2013.01); *H04R 19/016* (2013.01); *H04R 19/04* (2013.01); *H04R 2201/003* (2013.01)

(58) Field of Classification Search

CPC ..... H04R 1/04; H04R 1/222; H04R 1/38; H04R 3/06; H04R 19/005; H04R 19/016; H04R 19/04; H04R 25/604; H04R 31/006; H04R 2201/003

USPC ..... 381/113, 355, 356, 357, 358, 360, 369, 381/173, 174, 175, 191, 345, 349, 351, 353

See application file for complete search history.

(56) References Cited

U.S. PATENT DOCUMENTS

| | | | | |
|---|---|---|---|---|
| 3,963,881 | A * | 6/1976 | Fraim | H04R 1/38 381/173 |
| 4,281,222 | A * | 7/1981 | Nakagawa | H04R 19/016 381/174 |
| 4,993,072 | A | 2/1991 | Murphy | |
| 5,146,435 | A | 9/1992 | Bernstein | |
| 5,452,268 | A | 9/1995 | Bernstein | |
| 5,490,220 | A | 2/1996 | Loeppert | |
| 5,677,965 | A | 10/1997 | Moret et al. | |
| 5,870,482 | A | 2/1999 | Loeppert et al. | |
| 6,088,463 | A | 7/2000 | Rombach et al. | |
| 2002/0067663 | A1 | 6/2002 | Loeppert | |
| 2012/0051575 | A1 * | 3/2012 | Akino | H04R 1/04 381/355 |

* cited by examiner

*Primary Examiner* — Huyen D Le

(74) *Attorney, Agent, or Firm* — IPro, PLLC; Na Xu; Qian Gu

(57) ABSTRACT

A silicon condenser microphone is disclosed. The silicon condenser microphone includes a substrate including a side surrounding a cavity, a transducer unit supported by the substrate, a partition positioned in the cavity of the substrate for dividing the cavity into an upper cavity and a lower cavity. The transducer unit includes a backplate and a diaphragm forming a capacitor. The partition includes a main body connected to an inner surface of the side of the substrate, and a perforation penetrating the main body for communicating the upper cavity with the lower cavity. The sensitivity of the silicon condenser microphone is accordingly improved.

5 Claims, 2 Drawing Sheets

SILICON CONDENSER MICROPHONE

FIELD OF THE INVENTION

The present invention relates to microphones, more particularly to a silicon condenser microphone.

DESCRIPTION OF RELATED ART

With the rapid development of wireless communication technologies, mobile phones are widely used in daily life. Users require mobile phones to not only have voice function, but also have high quality voice performance. In addition, with the development of mobile multi-media technologies, sounds, like music, voice, are of importance to a device for performing the multi-media functions. As a sound pick-up device, a microphone is a necessary and important component used in a mobile phone to convert sounds to electrical signals for transmitting the sounds to other devices.

Miniaturized silicon microphones have been extensively developed for over sixteen years, since the first silicon piezoelectric microphone reported by Royer in 1983. In 1984, Hohm reported the first silicon electret-type microphone, made with a metallized polymer diaphragm and silicon backplate. And two years later, he reported the first silicon condenser microphone made entirely by silicon micro-machining technology. Since then a number of researchers have developed and published reports on miniaturized silicon condenser microphones of various structures and performance. U.S. Pat. No. 5,870,482 to Loeppert et al reveals a silicon microphone. U.S. Pat. No. 5,490,220 to Loeppert shows a condenser and microphone device. U.S. Patent Application Publication 2002/0067663 to Loeppert et al shows a miniature acoustic transducer. U.S. Pat. No. 6,088,463 to Rombach et al teaches a silicon condenser microphone process. U.S. Pat. No. 5,677,965 to Moret et al shows a capacitive transducer. U.S. Pat. Nos. 5,146,435 and 5,452,268 to Bernstein disclose acoustic transducers. U.S. Pat. No. 4,993,072 to Murphy reveals a shielded electret transducer.

Various microphone designs have been invented and conceptualized by using silicon micro-machining technology. Despite various structural configurations and materials, the silicon condenser microphone consists of four basic elements: a movable compliant diaphragm, a rigid and fixed backplate (which together form a variable air gap capacitor), a voltage bias source, and a pre-amplifier. These four elements fundamentally determine the performance of the condenser microphone. In pursuit of high performance; i.e., high sensitivity, low bias, low noise, and wide frequency range, the key design considerations are to have a large size of diaphragm and a large air gap. The former will help increase sensitivity as well as lower electrical noise, and the later will help reduce acoustic noise of the microphone. The large air gap requires a thick sacrificial layer. For releasing the sacrificial layer, the backplate is provided with a plurality of through holes.

As known, a silicon condenser microphone is also named MEMS (Micro-Electro-Mechanical-System) microphone. A microphone related to the present application generally includes a substrate, a housing forming a volume cooperatively with the substrate, a MEMS die accommodated in the volume, and an ASIC (Application Specific Integrated Circuit) chip received in the volume and electrically connected with the MEMS die.

For a typical MEMS microphone, it receives high frequency signals or low frequency signals, or ultrasonic signals. When receiving ultrasonic signals, the MEMS microphone may be used as a component for performing Gesture Recognition. When receiving low frequency signals, the MEMS microphone has relatively high sensitivity. When receiving high frequency signals, (such as signals within 30 kHz~60 kHz), however, the MEMS microphone has relatively lower sensitivity. The reason is that the sound pressure on the diaphragm caused by signals with low frequencies will keep constant, but the sound pressure on the diaphragm caused by signals with high frequencies will drop down. For example, the sound pressure on the diaphragm caused by signals of 60 kHz is 10 dB lower than the sound pressure on the diaphragm caused by signals of 1 kHz. Thus, the sensitivity of the MEMS microphone will rapidly drop down when receiving signals of high frequencies.

Accordingly, an improved silicon condenser microphone which can overcome the disadvantage described above is desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
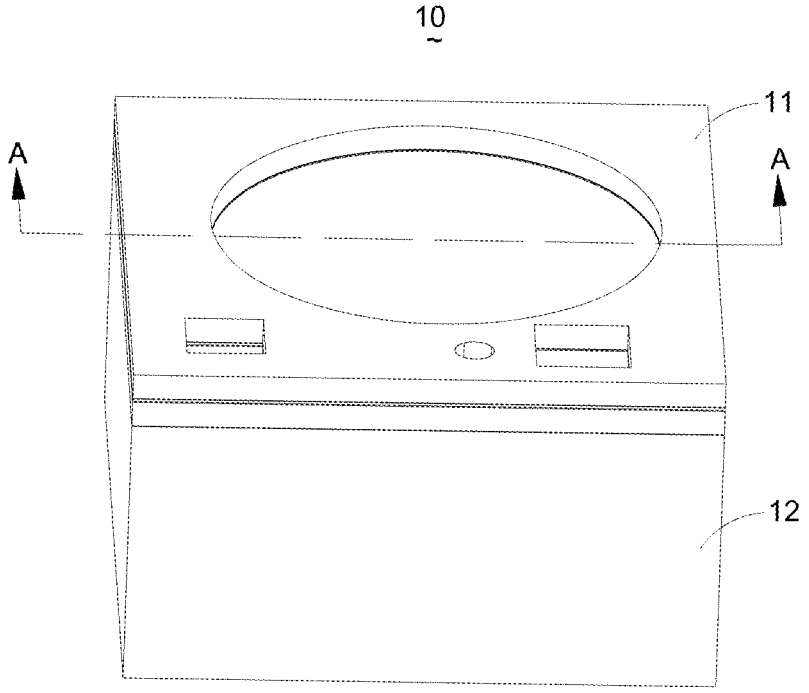
FIG. 1 is an illustrative isometric view of a silicon condenser microphone in accordance with the present disclosure.

Referring to FIG. 1, an illustration of a silicon condenser microphone 10 of the present disclosure, the silicon condenser microphone 10 is a necessary component of a silicon condenser microphone package used for converting sounds into electrical signals. The silicon condenser microphone 10 includes a substrate 12 and a transducer unit 11 supported by the substrate 12.

Figure 2:
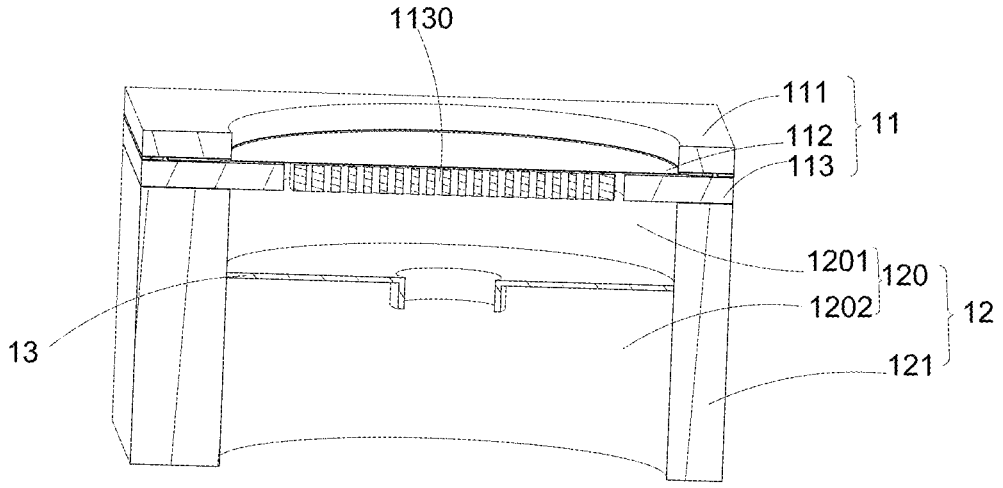
FIG. 2 is a cross-sectional view of the silicon condenser microphone in FIG. 1.

Referring to FIG. 2 that is a cross-sectional view of the silicon condenser microphone 10 in FIG. 1, the transducer unit 11 further includes a backplate 113, a diaphragm 112 arranged above the backplate 113, and a top cover 111 for fixing the diaphragm 112 to the substrate 12. An air gap is accordingly formed between the backplate 113 and the diaphragm 112. Basically, the backplate 113 and the diaphragm 112 are both provided with voltage but are isolative from each other. Thus, a capacitor is thereby formed by the backplate 113 and the diaphragm 112. The top cover 111 is an optional component for fixing the diaphragm 112. The backplate 113 further includes a plurality of through holes 1130 for balancing the air pressure in the air gap during vibration of the diaphragm 112. In this embodiment, the backplate 113 is directly arranged on the substrate 12, and the diaphragm 112 is arranged above the backplate 113. In other embodiment, the diaphragm 112 may be anchored to the substrate 12, and the backplate 113 may be arranged above the diaphragm 112.

The substrate 12 includes a side 121 defining a cavity 120. In addition, the silicon condenser microphone 10 includes a partition 13 disposed in the cavity 120 for dividing the cavity 120 into an upper cavity 1201 and a lower cavity 1202. For communicating the upper cavity 1201 with the lower cavity 1202, the partition 13 includes at least one penetration.

Figure 3:
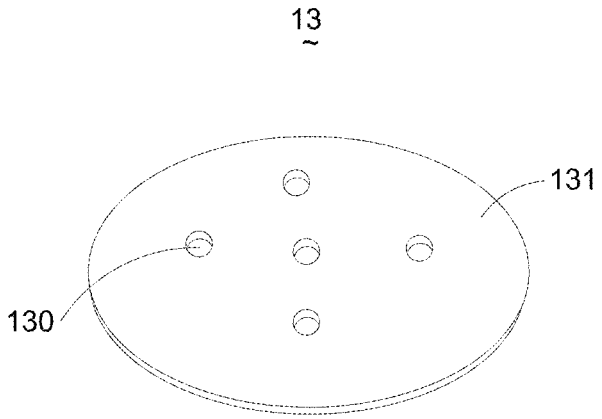
FIG. 3 is an isometric view of a first configuration of a partition of the silicon condenser microphone.

Referring to FIGS. 2-3, a first configuration of the partition 13 is shown. The partition 13 includes a main body 131 and a plurality of perforations 130 penetrating the main body 131 for communicating the upper cavity 1201 with the lower cavity 1202. In this embodiment, the partition 13 is parallel to the transducer unit 11, more particularly parallel to the diaphragm 112 or to the backplate 113. In fact, the partition 13 is used to dividing the cavity into two cavities, so, the position of the partition is not restricted to a position parallel to the transducer unit. However, the partition 13 should be connected to the side 121 with an edge of the partition 13 sealed with an inner surface of the side 121. Optionally, the partition 13 is integrated with the side 121 by MEMS process. Position or amount of the perforations is adjustable according to actual requirements. The partition 13 with perforations 130 could adjust the sound pressure arriving at the diaphragm for improving the sensitivity of the silicon condenser microphone when the microphone receives signals with high frequencies.

Figure 4:
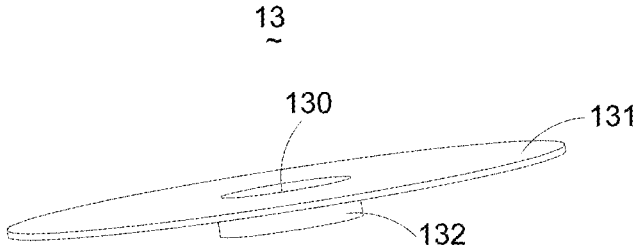
FIG. 4 is an isometric view of a second configuration of a partition of the silicon condenser microphone.

Referring to FIGS. 2 and 4, a second configuration of the partition 13 is shown. The partition 13 includes a main body 131 and a protrusion 132 extending perpendicularly from the main body along a direction far away from the transducer unit 11. A perforation 130 is formed penetrating the protrusion 132 and the main body 131. A diameter of the protrusion is obviously smaller than that of the main body 131. In this embodiment, the protrusion 132 forms only one perforation 130, but in fact, the protrusion 132 may form a plurality of perforations according to actual requirements. And, the height or the diameter of the protrusion 132 may be adjusted according to actual applications.

The partition divides the cavity of the substrate into an upper cavity and a lower cavity, and airflow produced by the vibration of the sound waves enters the air gap from the lower cavity to the upper cavity via the perforation in the partition, which generates resonance in the cavity, and improves the sound pressure on the diaphragm. Therefore, the sensitivity of the silicon condenser microphone is accordingly improved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A silicon condenser microphone, comprising:

a substrate including a side surrounding a cavity;

a transducer unit supported by the substrate, including a backplate and a diaphragm forming a capacitor with the backplate;

a partition positioned in the cavity of the substrate for dividing the cavity into an upper cavity and a lower cavity, the partition including a main body connected to an inner surface of the side of the substrate, a protrusion extending from the main body, and a perforation penetrating the protrusion and the main body for communicating the upper cavity with the lower cavity.

2. The silicon condenser microphone as described in claim 1 further including a top cover for fixing the diaphragm.

3. The silicon condenser microphone as described in claim 1, wherein the backplate attaches to the substrate and forms a plurality of through holes.

4. The silicon condenser microphone as described in claim 1, wherein the protrusion extends from the main body along a direction far away from the transducer unit.

5. The silicon condenser microphone as described in claim 1, wherein a diameter of the protrusion is smaller than the diameter of the main body.

* * * * *